US011898285B2

(12) United States Patent
Huang et al.

(10) Patent No.: US 11,898,285 B2
(45) Date of Patent: Feb. 13, 2024

(54) MODIFIED POLYPROPYLENE SPUNBOND NON-WOVEN FABRIC AND PREPARATION METHOD THEREOF

(71) Applicant: BESTEE MATERIAL (TSINGTAO) CO., LTD., Qingdao (CN)

(72) Inventors: Xiaohua Huang, Qingdao (CN); Qiang Cai, Qingdao (CN); Shichao Wang, Qingdao (CN); Weihua Mu, Qingdao (CN); Jie Liu, Qingdao (CN); Yongmei Ma, Qingdao (CN); Yu Liu, Qingdao (CN); Li Zhen, Qingdao (CN)

(73) Assignee: BESTEE MATERIAL (TSINGTAO) CO., LTD., Qingdao (CN)

( * ) Notice: Subject to any disclaimer, the term of this patent is extended or adjusted under 35 U.S.C. 154(b) by 24 days.

(21) Appl. No.: 17/231,159

(22) Filed: Apr. 15, 2021

(65) Prior Publication Data

US 2021/0324556 A1 Oct. 21, 2021

(30) Foreign Application Priority Data

Apr. 17, 2020 (CN) ..... 202010303575.6

(51) Int. Cl.

| | |
|---|---|
| ***D04H 3/16*** | (2006.01) |
| ***D04H 3/007*** | (2012.01) |
| ***D01F 1/10*** | (2006.01) |
| ***D01F 6/46*** | (2006.01) |

(52) U.S. Cl.

CPC ..... *D04H 3/16* (2013.01); *D01F 1/103* (2013.01); *D01F 6/46* (2013.01); *D04H 3/007* (2013.01)

(58) Field of Classification Search

None

See application file for complete search history.

(56) References Cited

U.S. PATENT DOCUMENTS

| | | | | |
|---|---|---|---|---|
| 2005/0003980 | A1* | 1/2005 | Baker | D06L 1/04 510/276 |
| 2006/0160448 | A1* | 7/2006 | Abraham | A61L 15/30 264/211 |
| 2012/0184166 | A1* | 7/2012 | Kurihara | D01F 6/84 525/450 |
| 2012/0237576 | A1* | 9/2012 | Gordon | C11D 17/042 510/276 |
| 2015/0044267 | A1* | 2/2015 | Gray | D06M 13/148 96/11 |

FOREIGN PATENT DOCUMENTS

| | | | |
|---|---|---|---|
| CN | 106400308 | * | 2/2017 |

OTHER PUBLICATIONS

Machine Translation of CN106400308 (Year: 2017).*

* cited by examiner

*Primary Examiner* — Shawn Mckinnon

(74) *Attorney, Agent, or Firm* — ANOVA LAW GROUP, PLLC

(57) ABSTRACT

A modified polypropylene spunbond non-woven fabric and a preparation method of the modified polypropylene spunbond non-woven fabric are provided. The modified polypropylene spunbond non-woven fabric contains a modified nanocomposite material including an organic compound, the organic compound including one of tea polyphenol, naringin, and emodin. The organic compound is in a weight percentage range of approximately 0.1%-5% based on a total weight of the modified polypropylene spunbond non-woven fabric.

10 Claims, No Drawings

MODIFIED POLYPROPYLENE SPUNBOND NON-WOVEN FABRIC AND PREPARATION METHOD THEREOF

CROSS-REFERENCE TO RELATED APPLICATION

This application claims the priority of Chinese patent application No. 202010303575.6, filed on Apr. 17, 2020, the entirety of which is incorporated herein by reference.

FIELD OF THE DISCLOSURE

The present disclosure generally relates to the field of textile technology and, more particularly, relates to a modified polypropylene spunbond non-woven fabric and a preparation method thereof.

BACKGROUND

The polypropylene (PP) spunbond non-woven fabric is prepared using polypropylene as a raw material, and has a breathable rather than water-permeable fiber structure prepared by a high-temperature spinning carding and bonding into a web. The non-woven fabric is featured with advantages of moisture-proof, breathable, flexible, light, non-combustion-supporting, easy-to-decompose, non-toxic, non-irritating, colorful, low price, and recyclable, etc., and is mainly used for disposable medical and hygiene product, disposable antifouling clothing, agricultural fabric, furniture fabric, or lining material, etc.

Tea polyphenol is a general term for polyphenols in tea. Tea polyphenol is a white amorphous powder and is easily soluble in water. Green tea has a substantially high content of tea polyphenol, which accounts for 15%-30% of mass of the green tea. The main components of tea polyphenol includes six types of compounds of flavanones, anthocyanins, flavonols, anthocyanins, phenolic acids and depsilic acids. Tea polyphenol has a substantially high content of flavanones, which account for 60%-80% of total mass of the tea polyphenol, followed by flavonoids. The contents of other phenols are substantially small. Tea polyphenol has a strong antibacterial effect and inhibit oxidase function.

Naringin is mainly found in the fruit of rutaceae plant pomelo, the peels and pulps of grapefruit, tangerine, and orange. Naringin is a pale yellow powder or off-white powder, and belongs to flavonoids. Naringin has anti-inflammatory, anti-viral, anti-cancer, anti-mutation, anti-allergic, anti-ulcer, analgesic, and lowering blood pressure functions. Naringin is capable of lowering blood cholesterol, reducing thrombus formation, and improving local microcirculation and nutritional supply, and can be used for prevention and treatment of cardiovascular and cerebrovascular diseases.

Emodin is an orange-yellow long needle-like crystal, which is orange when crystallized in acetone, and yellow when crystallized in methanol. Emodin has inhibitory effect on *Staphylococcus aureus* 209P, *Streptococcus, Bacillus* diphtheriae, *Bacillus subtilis, Bacillus* paratyphi, *Bacillus* dysentery, *Escherichia coli*, influenza *bacillus*, pneumococcus, and Catarrhal cocci, etc., and has a substantially strong inhibitory effect on common clinical anaerobic bacteria.

The existing method modifies the non-woven fabric by adding specific raw materials when preparing the non-woven fabric. However, the current method easily destroys the component of an organic compound used for modification, and reduces the performance of the non-woven fabric.

The non-woven fabric made from fiber tends to have problems such as mildew, low softness, easy to shrink after hot rolling, poor air permeability, etc. The disclosed methods and non-woven fabric are directed to solve one or more problems set forth above and other problems.

BRIEF SUMMARY OF THE DISCLOSURE

One aspect of the present disclosure includes a modified polypropylene spunbond non-woven fabric. The modified polypropylene spunbond non-woven fabric contains a modified nanocomposite material including an organic compound, the organic compound including one of tea polyphenol, naringin, and emodin. The organic compound is in a weight percentage range of approximately 0.1%-5% based on a total weight of the modified polypropylene spunbond non-woven fabric.

In one embodiment, the modified nanocomposite material is formed by adding the organic compound into water to form a solution, and stirring the solution until the organic compound is fully dissolved; and adding a porous nanomaterial into the solution to form a mixture, and stirring the mixture to obtain the modified nanocomposite material. The organic compound includes one of the tea polyphenol, the naringin, and the emodin.

In one embodiment, a mass ratio of the organic compound over the water is in a range of approximately 1:(5-10).

In one embodiment, when the organic compound is the naringin, the naringin is dissolved at a heated temperature in a range of approximately 50° C.-80° C.

In one embodiment, when the organic compound is the emodin, the emodin is dissolved by further adding sodium carbonate.

In one embodiment, the porous nanomaterial includes one or more of montmorillonite, zeolite powder, porous nano-$TiO_2$ microspheres, and porous nano-$SiO_2$ microspheres.

In one embodiment, a mass ratio of the organic compound over the porous nanomaterial is in a range of approximately 1:(5-10).

In one embodiment, a stirring speed for the mixture containing the porous nanomaterial is in a range of approximately 30 r/min-60 r/min, and a stirring duration is in a range of approximately 30 minutes-120 minutes.

Another aspect of the present disclosure includes a preparation method of a modified polypropylene spunbond non-woven fabric. The method includes modifying an organic compound to provide a modified nanocomposite material, the organic compound including one of tea polyphenol, naringin, and emodin. The method also includes preparing a composite modifier, by performing: adding a fat-soluble solvent into the modified nanocomposite material, and grinding the modified nanocomposite material to provide the composite modifier. Further, the method includes preparing the polypropylene spunbond non-woven fabric, by performing: melt-mixing polypropylene chips in a twin-screw extruder, adding the composite modifier into the twin-screw extruder, mixing the composite modifier and a melt of the polypropylene chips, spinning and pulling the mixed composite modifier and the melt of the polypropylene chips to form a fiber net, and hot-rolling the fiber net into a fabric by a hot-rolling machine to provide the modified polypropylene spunbond non-woven fabric.

In one embodiment, modifying the organic compound includes: adding the organic compound into water to form a solution, and stirring the solution until the organic compound is fully dissolved; and adding a porous nanomaterial into the solution to form a mixture, and stirring the mixture to provide the modified nanocomposite material.

In one embodiment, the fat-soluble solvent includes one or more of wax, high-grade fatty acid glyceride, and stearic acid.

In one embodiment, grinding the modified nanocomposite material includes a grinding particle size in a range of approximately 8000 mesh-10000 mesh.

In one embodiment, a mass ratio of the organic compound over the water is in a range of approximately 1:(5-10).

In one embodiment, when the organic compound is the naringin, the naringin is dissolved at a heated temperature in a range of approximately 50° C.-80° C.

In one embodiment, when the organic compound is the emodin, the emodin is dissolved by further adding sodium carbonate.

In one embodiment, the porous nanomaterial includes one or more of montmorillonite, zeolite powder, porous nano-$TiO_2$ microspheres, and porous nano-$SiO_2$ microspheres.

In one embodiment, a mass ratio of the organic compound over the porous nanomaterial is in a range of approximately 1:(5-10).

In one embodiment, a stirring speed for the mixture containing the porous nanomaterial is in a range of approximately 30 r/min-60 r/min, and a stirring duration is in a range of approximately 30 minutes-120 minutes.

Another aspect of the present disclosure includes a modified polypropylene spunbond non-woven fabric prepared by the above-disclosed method.

Other aspects of the present disclosure can be understood by those skilled in the art in light of the description, the claims, and the drawings of the present disclosure.

DETAILED DESCRIPTION

To make the objectives, technical solutions and advantages of the present disclosure clearer and more explicit, the present disclosure is described in further detail with accompanying embodiments. It should be understood that the specific exemplary embodiments described herein are only for explaining the present disclosure and are not intended to limit the present disclosure.

Various embodiments provide a modified polypropylene spunbond non-woven fabric and preparation method. The modified polypropylene spunbond non-woven fabric may contain a modified nanocomposite material including an organic compound. The organic compound may include one or more of tea polyphenol, naringin, and emodin. The organic compound may be in a weight percentage range of approximately 0.1%-5% based on a total weight of the modified polypropylene spunbond non-woven fabric.

During preparation, the organic compound may be modified by: adding the organic compound into water to form a solution, and stirring the solution until the organic compound is fully dissolved; and adding a porous nanomaterial into the solution to form a mixture, and stirring the mixture to provide the modified nanocomposite material to provide a modified nanocomposite material.

In one embodiment, the modified nanocomposite material may be added into a fat-soluble solvent and then be ground to form the composite modifier. For preparing the polypropylene spunbond non-woven fabric, when melt-mixing polypropylene chips in a twin-screw extruder, the composite modifier is added into the twin-screw extruder for mixing the composite modifier and a melt of the polypropylene chips. The mixed composite modifier and the melt of the polypropylene chips may be spun and pulled to form a fiber net, followed by hot-rolling the fiber net into a fabric by a hot-rolling machine to provide the modified polypropylene spunbond non-woven fabric.

In one embodiment, the fat-soluble solvent includes one or more of wax, high-grade fatty acid glyceride, and stearic acid. In one embodiment, the porous nanomaterial includes one or more of montmorillonite, zeolite powder, porous nano-$TiO_2$ microspheres, and porous nano-$SiO_2$ microspheres.

Exemplary Embodiment 1

The present disclosure provides a tea polyphenol-modified polypropylene (PP) spunbond non-woven fabric. The tea polyphenol-modified PP spunbond non-woven fabric may contain tea polyphenol in a weight percentage of approximately 0.1%. Modifying tea polyphenol may include: adding tea polyphenol into water to form a solution, and stirring the solution until the tea polyphenol is fully dissolved, where a mass ratio of the tea polyphenol over water may be approximately 1:5; adding porous nano-$TiO_2$ microspheres into the solution to form a mixture, where a mass ratio of the tea polyphenol over the porous nano-$TiO_2$ microspheres may be approximately 1:5; and stirring the mixture at a speed of approximately 30 r/min for approximately 120 minutes, to obtain a modified nanocomposite material. In other words, the modified nanocomposite material may include an organic compound, and the organic compound may include tea polyphenol.

The preparation method of the tea polyphenol-modified PP spunbond non-woven fabric may include following.

(1) Preparation of a composite modifier: adding an appropriate amount of wax into the modified nanocomposite material, and grinding the modified nanocomposite material with a grinding particle size of approximately 8000 mesh, to obtain the composite modifier.

(2) Preparation of the modified PP spunbond non-woven fabric: melt-mixing PP chips in a twin-screw extruder; adding the composite modifier into the twin-screw extruder by injecting, to be mixed with melt of the PP chips, where a mass ratio of the composite modifier over the PP chips may be approximately 1:100; obtaining a fiber net by spinning and pulling the mixed composite modifier and the melt of the PP chips; and hot-rolling the fiber net into a fabric by a hot-rolling machine to obtain the tea polyphenol-modified PP spunbond non-woven fabric.

Exemplary Embodiment 2

The present disclosure provides a tea polyphenol-modified polypropylene (PP) spunbond non-woven fabric. The tea polyphenol-modified PP spunbond non-woven fabric may contain tea polyphenol in a weight percentage of approximately 2.5%. Modifying tea polyphenol may include: adding tea polyphenol into water to form a solution, and stirring the solution until the tea polyphenol is fully dissolved, where a mass ratio of the tea polyphenol over water may be approximately 1:7.5; adding porous nano-$SiO_2$ microspheres into the solution to form a mixture, where a mass ratio of the tea polyphenol over the porous nano-$SiO_2$ microspheres may be approximately 1:7.5; and stirring the mixture at a speed of approximately 45 r/min for approximately 75 minutes, to obtain a modified nanocomposite material. In other words, the modified nanocomposite material may include an organic compound, and the organic compound may include tea polyphenol.

The preparation method of the tea polyphenol-modified PP spunbond non-woven fabric may include following.

(1) Preparation of a composite modifier: adding an appropriate amount of high-grade fatty acid glyceride into the modified nanocomposite material, and grinding the modified nanocomposite material with a grinding particle size of approximately 9000 mesh, to obtain the composite modifier.

(2) Preparation of the modified PP spunbond non-woven fabric: melt-mixing PP chips in a twin-screw extruder; adding the composite modifier into the twin-screw extruder by injecting, to be mixed with melt of the PP chips, where a mass ratio of the composite modifier over the PP chips may be approximately 4.5:100; obtaining a fiber net by spinning and pulling the mixed composite modifier and the melt of the PP chips; and hot-rolling the fiber net into a fabric by a hot-rolling machine to obtain the tea polyphenol-modified PP spunbond non-woven fabric.

Exemplary Embodiment 3

The present disclosure provides a tea polyphenol-modified polypropylene (PP) spunbond non-woven fabric. The tea polyphenol-modified PP spunbond non-woven fabric may contain tea polyphenol in a weight percentage of approximately 5%. Modifying tea polyphenol may include: adding tea polyphenol into water to form a solution, and stirring the solution until the tea polyphenol is fully dissolved, where a mass ratio of the tea polyphenol over water may be approximately 1:10; adding montmorillonite and porous nano-$SiO_2$ microspheres into the solution to form a mixture, where a mass ratio of the tea polyphenol over the montmorillonite and the porous nano-$SiO_2$ microspheres may be approximately 1:10, and a mass ratio of the montmorillonite over the porous nano-$SiO_2$ microspheres may be approximately 1:1; and stirring the mixture at a speed of approximately 60 r/min for approximately 30 minutes, to obtain a modified nanocomposite material. In other words, the modified nanocomposite material may include an organic compound, and the organic compound may include tea polyphenol.

The preparation method of the tea polyphenol-modified PP spunbond non-woven fabric may include following.

(1) Preparation of a composite modifier: adding an appropriate amount of stearic acid into the modified nanocomposite material, and grinding the modified nanocomposite material with a grinding particle size of approximately 10000 mesh, to obtain the composite modifier.

(2) Preparation of the modified PP spunbond non-woven fabric: melt-mixing PP chips in a twin-screw extruder; adding the composite modifier into the twin-screw extruder by injecting, to be mixed with melt of the PP chips, where a mass ratio of the composite modifier over the PP chips may be approximately 8:100; obtaining a fiber net by spinning and pulling the mixed composite modifier and the melt of the PP chips; and hot-rolling the fiber net into a fabric by a hot-rolling machine to obtain the tea polyphenol-modified PP spunbond non-woven fabric.

Exemplary Embodiment 4

The present disclosure provides a naringin-modified polypropylene (PP) spunbond non-woven fabric. The naringin-modified PP spunbond non-woven fabric may contain naringin in a weight percentage of approximately 0.1%. Modifying naringin may include: adding naringin into water to form a solution, and stirring the solution at a heated temperature of approximately 50° C. until the naringin is fully dissolved, where a mass ratio of the naringin over water may be approximately 1:5; and adding zeolite powder into the solution to form a mixture, where a mass ratio of the naringin over the zeolite powder may be approximately 1:5; and stirring the mixture at a speed of approximately 30 r/min for approximately 120 minutes, to obtain a modified nanocomposite material. In other words, the modified nanocomposite material may include an organic compound, and the organic compound may include naringin.

The preparation method of the naringin-modified PP spunbond non-woven fabric may include following.

(1) Preparation of a composite modifier: adding an appropriate amount of high-grade fatty acid glyceride into the modified nanocomposite material, and grinding the modified nanocomposite material with a grinding particle size of approximately 8000 mesh, to obtain the composite modifier.

(2) Preparation of the modified PP spunbond non-woven fabric: melt-mixing PP chips in a twin-screw extruder; adding the composite modifier into the twin-screw extruder by injecting, to be mixed with melt of the PP chips, where a mass ratio of the composite modifier over the PP chips may be approximately 1:100; obtaining a fiber net by spinning and pulling the mixed composite modifier and the melt of the PP chips; and hot-rolling the fiber net into a fabric by a hot-rolling machine to obtain the naringin-modified PP spunbond non-woven fabric.

Exemplary Embodiment 5

The present disclosure provides a naringin-modified polypropylene (PP) spunbond non-woven fabric. The naringin-modified PP spunbond non-woven fabric may contain naringin in a weight percentage of approximately 2.5%. Modifying naringin may include: adding naringin into water to form a solution, and stirring the solution at a heated temperature of approximately 65° C. until the naringin is fully dissolved, where a mass ratio of the naringin over water may be approximately 1:7.5; and adding porous nano-$SiO_2$ microspheres into the solution to form a mixture, where a mass ratio of the naringin over the porous nano-$SiO_2$ microspheres may be approximately 1:7.5; and stirring the mixture at a speed of approximately 45 r/min for approximately 75 minutes, to obtain a modified nanocomposite material. In other words, the modified nanocomposite material may include an organic compound, and the organic compound may include naringin.

The preparation method of the naringin-modified PP spunbond non-woven fabric may include following.

(1) Preparation of a composite modifier: adding an appropriate amount of stearic acid into the modified nanocomposite material, and grinding the modified nanocomposite material with a grinding particle size of approximately 9000 mesh, to obtain the composite modifier.

(2) Preparation of the modified PP spunbond non-woven fabric: melt-mixing PP chips in a twin-screw extruder; adding the composite modifier into the twin-screw extruder by injecting, to be mixed with melt of the PP chips, where a mass ratio of the composite modifier over the PP chips may be approximately 4.5:100; obtaining a fiber net by spinning and pulling the mixed composite modifier and the melt of the PP chips; and hot-rolling the fiber net into a fabric by a hot-rolling machine to obtain the naringin-modified PP spunbond non-woven fabric.

Exemplary Embodiment 6

The present disclosure provides a naringin-modified polypropylene (PP) spunbond non-woven fabric. The naringin-modified PP spunbond non-woven fabric may contain naringin in a weight percentage of approximately 5%. Modifying naringin may include: adding naringin into water to form a solution, and stirring the solution at a heated temperature of approximately 80° C. until the naringin is fully dissolved, where a mass ratio of the naringin over water may be approximately 1:10; and adding montmorillonite and porous nano-$SiO_2$ microspheres into the solution to form a mixture, where a mass ratio of the naringin over the montmorillonite and the porous nano-$SiO_2$ microspheres may be approximately 1:10, and a mass ratio of the montmorillonite over the porous nano-$SiO_2$ microspheres may be approximately 1:1; and stirring the mixture at a speed of approximately 60 r/min for approximately 30 minutes, to obtain a modified nanocomposite material. In other words, the modified nanocomposite material may include an organic compound, and the organic compound may include naringin.

The preparation method of the naringin-modified PP spunbond non-woven fabric may include following.

(1) Preparation of a composite modifier: adding an appropriate amount of high-grade fatty acid glyceride into the modified nanocomposite material, and grinding the modified nanocomposite material with a grinding particle size of approximately 10000 mesh, to obtain the composite modifier.

(2) Preparation of the modified PP spunbond non-woven fabric: melt-mixing PP chips in a twin-screw extruder; adding the composite modifier into the twin-screw extruder by injecting, to be mixed with melt of the PP chips, where a mass ratio of the composite modifier over the PP chips may be approximately 8:100; obtaining a fiber net by spinning and pulling the mixed composite modifier and the melt of the PP chips; and hot-rolling the fiber net into a fabric by a hot-rolling machine to obtain the naringin-modified PP spunbond non-woven fabric.

Exemplary Embodiment 7

The present disclosure provides an emodin-modified polypropylene (PP) spunbond non-woven fabric. The emodin-modified PP spunbond non-woven fabric may contain emodin in a weight percentage of approximately 0.1%. Modifying emodin may include: adding emodin and an appropriate amount of sodium carbonate into water to form a solution, and stirring the solution until the emodin is fully dissolved, where a mass ratio of the emodin over water may be approximately 1:5; adding porous nano-$TiO_2$ microspheres into the solution to form a mixture, where a mass ratio of the emodin over the porous nano-$TiO_2$ microspheres may be approximately 1:5; and stirring the mixture at a speed of approximately 30 r/min for approximately 120 minutes, to obtain a modified nanocomposite material. In other words, the modified nanocomposite material may include an organic compound, and the organic compound may include emodin.

The preparation method of the emodin-modified PP spunbond non-woven fabric may include following.

(1) Preparation of a composite modifier: adding an appropriate amount of high-grade fatty acid glyceride into the modified nanocomposite material, and grinding the modified nanocomposite material with a grinding particle size of approximately 8000 mesh, to obtain the composite modifier.

(2) Preparation of the modified PP spunbond non-woven fabric: melt-mixing PP chips in a twin-screw extruder; adding the composite modifier into the twin-screw extruder by injecting, to be mixed with melt of the PP chips, where a mass ratio of the composite modifier over the PP chips may be approximately 1:100; obtaining a fiber net by spinning and pulling the mixed composite modifier and the melt of the PP chips; and hot-rolling the fiber net into a fabric by a hot-rolling machine to obtain the emodin-modified PP spunbond non-woven fabric.

Exemplary Embodiment 8

The present disclosure provides an emodin-modified polypropylene (PP) spunbond non-woven fabric. The emodin-modified PP spunbond non-woven fabric may contain emodin in a weight percentage of approximately 2.5%. Modifying emodin may include: adding emodin and an appropriate amount of sodium carbonate into water to form a solution, and stirring the solution until the emodin is fully dissolved, where a mass ratio of the emodin over water may be approximately 1:7.5; adding porous nano-$SiO_2$ microspheres into the solution to form a mixture, where a mass ratio of the emodin over the porous nano-$SiO_2$ microspheres may be approximately 1:7.5; and stirring the mixture at a speed of approximately 45 r/min for approximately 75 minutes, to obtain a modified nanocomposite material. In other words, the modified nanocomposite material may include an organic compound, and the organic compound may include emodin.

The preparation method of the emodin-modified PP spunbond non-woven fabric may include following.

(1) Preparation of a composite modifier: adding an appropriate amount of stearic acid into the modified nanocomposite material, and grinding the modified nanocomposite material with a grinding particle size of approximately 10000 mesh, to obtain the composite modifier.

(2) Preparation of the modified PP spunbond non-woven fabric: melt-mixing PP chips in a twin-screw extruder; adding the composite modifier into the twin-screw extruder by injecting, to be mixed with melt of the PP chips, where a mass ratio of the composite modifier over the PP chips may be approximately 4.5:100; obtaining a fiber net by spinning and pulling the mixed composite modifier and the melt of the PP chips; and hot-rolling the fiber net into a fabric by a hot-rolling machine to obtain the emodin-modified PP spunbond non-woven fabric.

Exemplary Embodiment 9

The present disclosure provides an emodin-modified polypropylene (PP) spunbond non-woven fabric. The emodin-modified PP spunbond non-woven fabric may contain emodin in a weight percentage of approximately 5%. Modifying emodin may include: adding emodin and an appropriate amount of sodium carbonate into water to form a solution, and stirring the solution until the emodin is fully dissolved, where a mass ratio of the emodin over water may be approximately 1:10; adding montmorillonite and porous nano-$SiO_2$ microspheres into the solution to form a mixture, where a mass ratio of the emodin over the montmorillonite and the porous nano-$SiO_2$ microspheres may be approximately 1:10, and a mass ratio of the montmorillonite over the porous nano-$SiO_2$ microspheres may be approximately 1:1; and stirring the mixture at a speed of approximately 60 r/min for approximately 30 minutes, to obtain a modified nanocomposite material. In other words, the modified nanocomposite material may include an organic compound, and the organic compound may include emodin.

The preparation method of the emodin-modified PP spunbond non-woven fabric may include following.

(1) Preparation of a composite modifier: adding an appropriate amount of high-grade fatty acid glyceride into the modified nanocomposite material, and grinding the modified nanocomposite material with a grinding particle size of approximately 9000 mesh, to obtain the composite modifier.

(2) Preparation of the modified PP spunbond non-woven fabric: melt-mixing PP chips in a twin-screw extruder; adding the composite modifier into the twin-screw extruder by injecting, to be mixed with melt of the PP chips, where a mass ratio of the composite modifier over the PP chips may be approximately 8:100; obtaining a fiber net by spinning and pulling the mixed composite modifier and the melt of the PP chips; and hot-rolling the fiber net into a fabric by a hot-rolling machine to obtain the emodin-modified PP spunbond non-woven fabric.

Comparative Embodiment 10

Embodiment 10 for preparing the tea polyphenol-modified polypropylene (PP) spunbond non-woven fabric may be based on the above described exemplary Embodiment 1, except that the tea polyphenol may not be modified.

Comparative Embodiment 11

Embodiment 11 for preparing the tea polyphenol-modified polypropylene (PP) spunbond non-woven fabric may be based on the above described exemplary Embodiment 1, except that the modified nanocomposite material may be directly ground without adding the fat-soluble solvent.

Comparative Embodiment 12

Embodiment 12 for preparing the tea polyphenol-modified polypropylene (PP) spunbond non-woven fabric may be based on the above described exemplary Embodiment 1, except that the composite modifier may not be prepared, and the PP chips and the modified nanocomposite material may be directly melt-mixed to prepare the non-woven fabric.

Antibacterial rates of the non-woven fabrics in exemplary Embodiments 1-9 and comparative Embodiments 10-12 may be tested, and the results may be shown in Table 1.

TABLE 1

| Embodiments | Antibacterial rate (%) | | |
|---|---|---|---|
| | *Staphylococcus aureus* | *Escherichia coli* | *Candida albicans* |
| Embodiment 1 | 96.8 | 98.6 | 97.1 |
| Embodiment 2 | 98.4 | 99.6 | 98.6 |
| Embodiment 3 | 98.1 | 97.4 | 96.5 |
| Embodiment 4 | 97.6 | 98.2 | 97.5 |
| Embodiment 5 | 98.9 | 99.5 | 98.9 |
| Embodiment 6 | 96.8 | 98.6 | 96.4 |
| Embodiment 7 | 96.2 | 98.2 | 97.2 |
| Embodiment 8 | 98.4 | 99.5 | 98.2 |
| Embodiment 9 | 97.6 | 97.4 | 97.6 |
| Embodiment 10 | 73.4 | 61.5 | 71.4 |
| Embodiment 11 | 63.8 | 59.8 | 68.5 |
| Embodiment 12 | 70.5 | 62.3 | 69.9 |

According to the results in Table 1, the antibacterial performance of the non-woven fabric prepared without modifying tea polyphenol may be significantly reduced. Because in the modification treatment, the porous nanomaterial has a substantially large specific surface area, the porous nanomaterial may encapsulate the tea polyphenol in pores of the porous nanomaterial, such that the composition of the tea polyphenol may not be destroyed when subsequently preparing the non-woven fabric, thereby improving the antibacterial performance of the non-woven fabric. The antibacterial performance of non-woven fabrics prepared without adding the fat-soluble solvent and without preparing the composite modifier may be significantly reduced, which may be due to the uneven dispersion of the tea polyphenol in the non-woven fabric. The performance of the non-woven fabrics in the present disclosure may be uniform. After being washed 50 times, the antibacterial rate of the modified non-woven fabric may still meet the standard requirements.

The above test may also be performed on the non-woven fabric in any other disclosed embodiment, and the results are basically consistent, which may not be listed one by one.

TABLE 2

| Embodiments | Air permeability ($m^3/m^2 \cdot s$) | Softness degree ($cN/mm^2$) | Water absorption (g) |
|---|---|---|---|
| Embodiment 1 | 421 | 3.56 | 0.87 |
| Embodiment 2 | 436 | 3.64 | 0.95 |
| Embodiment 3 | 429 | 3.51 | 0.82 |
| Embodiment 4 | 430 | 3.49 | 0.86 |
| Embodiment 5 | 435 | 3.58 | 0.94 |
| Embodiment 6 | 428 | 3.52 | 0.83 |
| Embodiment 7 | 426 | 3.61 | 0.89 |
| Embodiment 8 | 441 | 3.78 | 0.96 |
| Embodiment 9 | 432 | 3.64 | 0.84 |
| Embodiment 10 | 296 | 2.14 | 0.21 |
| Embodiment 11 | 310 | 2.26 | 0.28 |
| Embodiment 12 | 285 | 2.19 | 0.25 |

The performance of the non-woven fabrics in exemplary Embodiments 1-9 and comparative Embodiments 10-12 may be tested, and the results may be shown in Table 2. Water absorption may refer to weight of water absorbed by the modified PP spunbond non-woven fabric per unit area, and softness degree test method may include FZT 01054.4-1999 standard.

According to the results in Table 2, the non-woven fabric prepared by the disclosed preparation method may have desired softness degree, water absorption, and air permeability, and the non-woven fabrics prepared without modifying the tea polyphenol, without adding the fat-soluble solvent and without preparing the composite modifier may have substantially poor performance.

The above test may also be performed on the non-woven fabric in any other disclosed embodiment, and the results are basically consistent, which may not be listed one by one.

The present disclosure may have following beneficial effects. In the present disclosure, tea polyphenol, naringin or emodin may be modified using the porous nanomaterial. Because the porous nanomaterial has a substantially large specific surface area, the porous nanomaterial may encapsulate the tea polyphenol, naringin or emodin in the pores of the porous nanomaterial. Therefore, the composition of tea polyphenol, naringin or emodin may not be destroyed when subsequently preparing the non-woven fabric, thereby improving the performance of the non-woven fabric. Due to the addition of the tea polyphenol, naringin or emodin, the non-woven fabric may have improved antibacterial performance, and may have desired antibacterial performance against *Staphylococcus aureus, Escherichia coli*, and *Candida albicans*. After being washed 50 times, the antibacterial rate of the modified non-woven fabric may still meet the standard requirements.

In the present disclosure, the fat-soluble solvent may be added into the obtained modified nanocomposite material, and then the modified nanocomposite material may be ground, which may make the modified nanocomposite material be uniformly dispersed. The modified PP spunbond non-woven fabric may be obtained by mixing the composite modifier with PP chips, and spinning, etc., and the softness degree, air permeability, and water absorption of the non-woven fabric may be improved.

The above detailed descriptions only illustrate certain exemplary embodiments of the present disclosure, and are not intended to limit the scope of the present disclosure. Those skilled in the art can understand the specification as whole and technical features in the various embodiments can be combined into other embodiments understandable to those persons of ordinary skill in the art. Any equivalent or modification thereof, without departing from the spirit and principle of the present disclosure, falls within the true scope of the present disclosure.

What is claimed is:

1. A preparation method of a modified polypropylene spunbond non-woven fabric, comprising:

modifying an organic compound to provide a modified nanocomposite material, the organic compound comprising tea polyphenol, naringin, and emodin, wherein the organic compound is in a weight percentage range of approximately 0.1%-5% based on a total weight of the modified polypropylene spunbond non-woven fabric, wherein modifying the organic compound includes:

adding the organic compound into water to form a solution where the organic compound is fully dissolved; and adding a porous nanomaterial into the solution to form a mixture and stirring the mixture to form the modified nanocomposite material, wherein the porous nanomaterial includes one or more of montmorillonite, zeolite powder, porous nano-$TiO_2$ microspheres, and porous nano-$SiO_2$ microspheres;

preparing a composite modifier, by performing: adding a fat-soluble solvent into the modified nanocomposite material, and grinding the modified nanocomposite material to provide the composite modifier; and preparing the polypropylene spunbond non-woven fabric, by performing:

melt-mixing polypropylene chips in a twin-screw extruder, after a melt of the polypropylene chips is formed in the twin-screw extruder, adding the composite modifier into the twin-screw extruder, and mixing the composite modifier with the melt of the polypropylene chips to form a mixed melt, spinning and pulling the mixed melt to form a fiber net, and hot-rolling the fiber net into a fabric by a hot-rolling machine to provide the modified polypropylene spunbond non-woven fabric.

2. The method according to claim 1, wherein:

the fat-soluble solvent includes one or more of wax, high-grade fatty acid glyceride, and stearic acid.

3. The method according to claim 1, wherein:

grinding the modified nanocomposite material includes a grinding particle size in a range of approximately 8000 mesh-10000 mesh.

4. The method according to claim 1, wherein:

a mass ratio of the organic compound over the water is in a range of approximately 1:(5-10).

5. The method according to claim 1, wherein:

the naringin is dissolved at a heated temperature in a range of approximately 50° C.-80° C.

6. The method according to claim 1, wherein:

the emodin is dissolved by further adding sodium carbonate.

7. The method according to claim 1, wherein:

a mass ratio of the organic compound over the porous nanomaterial is in a range of approximately 1:(5-10).

8. The method according to claim 1, wherein:

a stirring speed for the mixture containing the porous nanomaterial is in a range of approximately 30 r/min-60 r/min, and a stirring duration is in a range of approximately 30 minutes-120 minutes.

9. A modified polypropylene spunbond non-woven fabric, prepared by the method according to claim 1.

10. The method according to claim 1, wherein adding the fat-soluble solvent into the modified nanocomposite material includes absorbing the fat-soluble solvent into the modified nanocomposite material.

* * * * *